US010242636B2

(12) United States Patent
Park et al.

(10) Patent No.: US 10,242,636 B2
(45) Date of Patent: Mar. 26, 2019

(54) DISPLAY DEVICE HAVING A REPAIR LINE TO MEASURE A TARGET POINT VOLTAGE AND OPERATING METHOD THEREOF

(71) Applicant: SAMSUNG DISPLAY CO., LTD., Yongin-si, Gyeonggi-do (KR)

(72) Inventors: Kyong Tae Park, Yongin-si (KR); Tae Gon Kim, Yongin-si (KR); Dong Hoon Jeong, Yongin-si (KR); Yu Hyun Cho, Yongin-si (KR)

(73) Assignee: Samsung Dispaly Co., Ltd., Yongin-si (KR)

( * ) Notice: Subject to any disclaimer, the term of this patent is extended or adjusted under 35 U.S.C. 154(b) by 0 days.

(21) Appl. No.: 15/182,477

(22) Filed: Jun. 14, 2016

(65) Prior Publication Data

US 2016/0365070 A1 Dec. 15, 2016

(30) Foreign Application Priority Data

Jun. 15, 2015 (KR) ..... 10-2015-0084511

(51) Int. Cl.

| | |
|---|---|
| ***G09G 3/30*** | (2006.01) |
| ***G09G 3/36*** | (2006.01) |
| ***G09G 3/3225*** | (2016.01) |
| *G09G 3/10* | (2006.01) |

(52) U.S. Cl.

CPC ..... *G09G 3/3648* (2013.01); *G09G 3/3225* (2013.01); *G09G 2300/043* (2013.01); *G09G 2300/0413* (2013.01); *G09G 2320/0233* (2013.01); *G09G 2320/045* (2013.01); *G09G 2330/08* (2013.01); *G09G 2330/12* (2013.01); *G09G 2360/16* (2013.01)

(58) Field of Classification Search

CPC ..... G09G 3/3225; G09G 3/3648
USPC ..... 345/76; 315/169.3
See application file for complete search history.

(56) References Cited

U.S. PATENT DOCUMENTS

| | | | | |
|---|---|---|---|---|
| 9,129,923 | B1 * | 9/2015 | Han | G09G 3/3233 |
| 9,147,723 | B1 * | 9/2015 | Lee | G09G 3/3225 |
| 2002/0080313 | A1 * | 6/2002 | Lim | G09G 3/3648 349/143 |
| 2010/0073357 | A1 * | 3/2010 | Min | G09G 3/3233 345/214 |
| 2010/0103203 | A1 * | 4/2010 | Choi | G09G 3/3283 345/690 |
| 2011/0084955 | A1 | 4/2011 | Kim | |

(Continued)

FOREIGN PATENT DOCUMENTS

| | | | | |
|---|---|---|---|---|
| KR | 10-0599593 | B1 | 7/2006 | |
| KR | 10-0666639 | * | 1/2007 | G09G 3/20 |

(Continued)

*Primary Examiner* — Adam J Snyder
(74) *Attorney, Agent, or Firm* — Lewis Roca Rothgerber Christie LLP

(57) ABSTRACT

A display device includes a display area including pixels connected to scan lines and data lines, a power supply for supplying a first power voltage to the pixels through first power lines, repair lines in parallel with the scan lines, a dummy pixel unit including dummy pixels respectively connected to the repair lines, and a sensing unit coupled to one of the repair lines that is not connected to the dummy pixels, wherein the sensing unit measures the first power voltage at a target point through the one of the repair lines that is not connected to the dummy pixels.

16 Claims, 5 Drawing Sheets

(56) References Cited

U.S. PATENT DOCUMENTS

| | | | | |
|---|---|---|---|---|
| 2011/0242087 | A1* | 10/2011 | Ebisuno | G09G 3/3233 345/212 |
| 2012/0056916 | A1* | 3/2012 | Ryu | G09G 3/3208 345/691 |
| 2012/0154352 | A1* | 6/2012 | Yamashita | G09G 3/3233 345/207 |
| 2013/0176349 | A1* | 7/2013 | Park | G09G 3/3258 345/690 |
| 2015/0161943 | A1* | 6/2015 | Shim | G09G 3/3225 345/76 |
| 2015/0187249 | A1* | 7/2015 | Tani | G09G 3/006 345/694 |
| 2015/0243222 | A1 | 8/2015 | Lee | |
| 2015/0262526 | A1 | 9/2015 | Park et al. | |
| 2016/0005383 | A1* | 1/2016 | Lee | G09G 3/3291 345/690 |
| 2016/0189593 | A1* | 6/2016 | Lee | G09G 3/2003 345/691 |
| 2016/0268364 | A1* | 9/2016 | Yin | G09G 3/3233 |

FOREIGN PATENT DOCUMENTS

| | | | |
|---|---|---|---|
| KR | 10-0666639 | B1 | 1/2007 |
| KR | 10-0669727 | B1 | 1/2007 |
| KR | 10-2011-0013693 | A | 2/2011 |
| KR | 10-1101070 | B1 | 12/2011 |
| KR | 10-2015-0107018 | A | 9/2015 |

* cited by examiner

DISPLAY DEVICE HAVING A REPAIR LINE TO MEASURE A TARGET POINT VOLTAGE AND OPERATING METHOD THEREOF

CROSS-REFERENCE TO RELATED APPLICATION

This application claims priority to, and the benefit of, Korean Patent Application No. 10-2015-0084511, filed on Jun. 15, 2015, in the Korean Intellectual Property Office, the entire content of which is incorporated herein by reference in its entirety.

BACKGROUND

1. Field

Aspects of embodiments of the present invention relate to a display device and an operating method thereof, and more particularly, a display device and an operating method thereof to effectively reduce a brightness deviation.

2. Description of the Related Art

With development of information technology, a display device that allows a user to be connected with information has gained increasing importance. Along with the growing importance, display apparatuses, such as liquid crystal display devices and organic light emitting display devices, are widely used.

In general, a display device includes a power supply for supplying a power voltage, and a display module for displaying an image on a screen by supplying the power voltage to a plurality of pixels.

A power source from the power supply is configured to be supplied to a plurality of pixels through wires connected thereto. However, a voltage drop may be caused by a wire resistance, which may lower the voltage of the power supplied to the pixels. Because a uniform power source might not be supplied to each of the pixels, the display device may not emit light with desired brightness, thereby generating a brightness deviation.

SUMMARY

Aspects of embodiments of the present invention are directed toward a display device and an operating method thereof, the display device including a sensing unit for sensing a change of a first power source supplied from a voltage supply unit to effectively eliminate a brightness deviation caused in a display region.

According to an embodiment of the present invention, there is provided a display device including a display area including pixels connected to scan lines and data lines, a power supply for supplying a first power voltage to the pixels through first power lines, repair lines in parallel with the scan lines, a dummy pixel unit including dummy pixels respectively connected to the repair lines, and a sensing unit coupled to one of the repair lines that is not connected to the dummy pixels, wherein the sensing unit measures the first power voltage at a target point through the one of the repair lines that is not connected to the dummy pixels.

The target point may be an electrical connection between one of the first power lines and the one of the repair lines that is not connected to the dummy pixels.

The target point may be on at least one horizontal line.

The target point may be in a vicinity of a center of the display area.

The display device may further include a data driver for supplying a data signal through the data lines.

The sensing unit may transmit a detected voltage to the data driver.

The data driver may include a voltage deviation generator for generating a deviation of the first power voltage, and a data voltage changing unit for generating a compensated data voltage by using the deviation of the first power voltage.

The voltage deviation generator may be configured to generate the deviation of the first power voltage by comparing a detected voltage corresponding to the measured first power voltage at the target point with a reference voltage of the target point.

The data voltage changing unit may be configured to generate the compensated data voltage by adjusting a voltage corresponding to the data signal by an amount corresponding to the deviation of the first power voltage.

A respective one of the dummy pixels may be on each horizontal line of the display area, and one of the dummy pixels on an ith (i is a natural number) horizontal line may be coupled between a kth (k is a natural number) dummy data line and an ith repair line.

When one of the pixels on the ith horizontal line is identified as defective, the ith repair line may be configured to be electrically coupled to an organic light emitting diode in the one of the pixels, and the kth dummy data line may be configured to be electrically coupled to one of the data lines connected to the one of the pixels.

According to an embodiment of the present invention, a method of operating a display device including pixels connected to scan lines and data lines, dummy pixels respectively coupled to one of repair lines formed in parallel with the scan lines, and a sensing unit coupled to one of the repair lines not connected to the dummy pixels, the method including detecting a first power voltage at a target point using the one of the repair lines, transmitting detected first power voltage to a data driver, and generating a compensated data voltage from the data driver by using the detected first power voltage.

The method may further include selecting the target point from among respective points of electrical connection between the repair lines and first power lines for supplying the first power voltage.

The target point may be on at least one of horizontal lines.

The target point may be in a vicinity of a center of a display area including the pixels.

The generating of the compensated data voltage may include generating a deviation of the first power voltage by comparing the detected first power voltage with a reference voltage of the target point, and generating a compensated data voltage by adjusting a voltage corresponding to a data signal to be supplied to the target point by an amount corresponding to the deviation of the first power voltage.

The method may further include supplying a compensated data signal, which corresponds to the compensated data voltage, to a pixel coupled to a first power line at the target point in response to a scan signal supplied through a respective one of the scan lines.

Accordingly a brightness deviation may be effectively eliminated by correcting the data signal based on a voltage drop of the first power voltage detected by the sensing unit, and by supplying a corrected data signal to the display region.

BRIEF DESCRIPTION OF THE DRAWINGS

Example embodiments will now be described more fully hereinafter with reference to the accompanying drawings, wherein.

DETAILED DESCRIPTION

Figure 1:
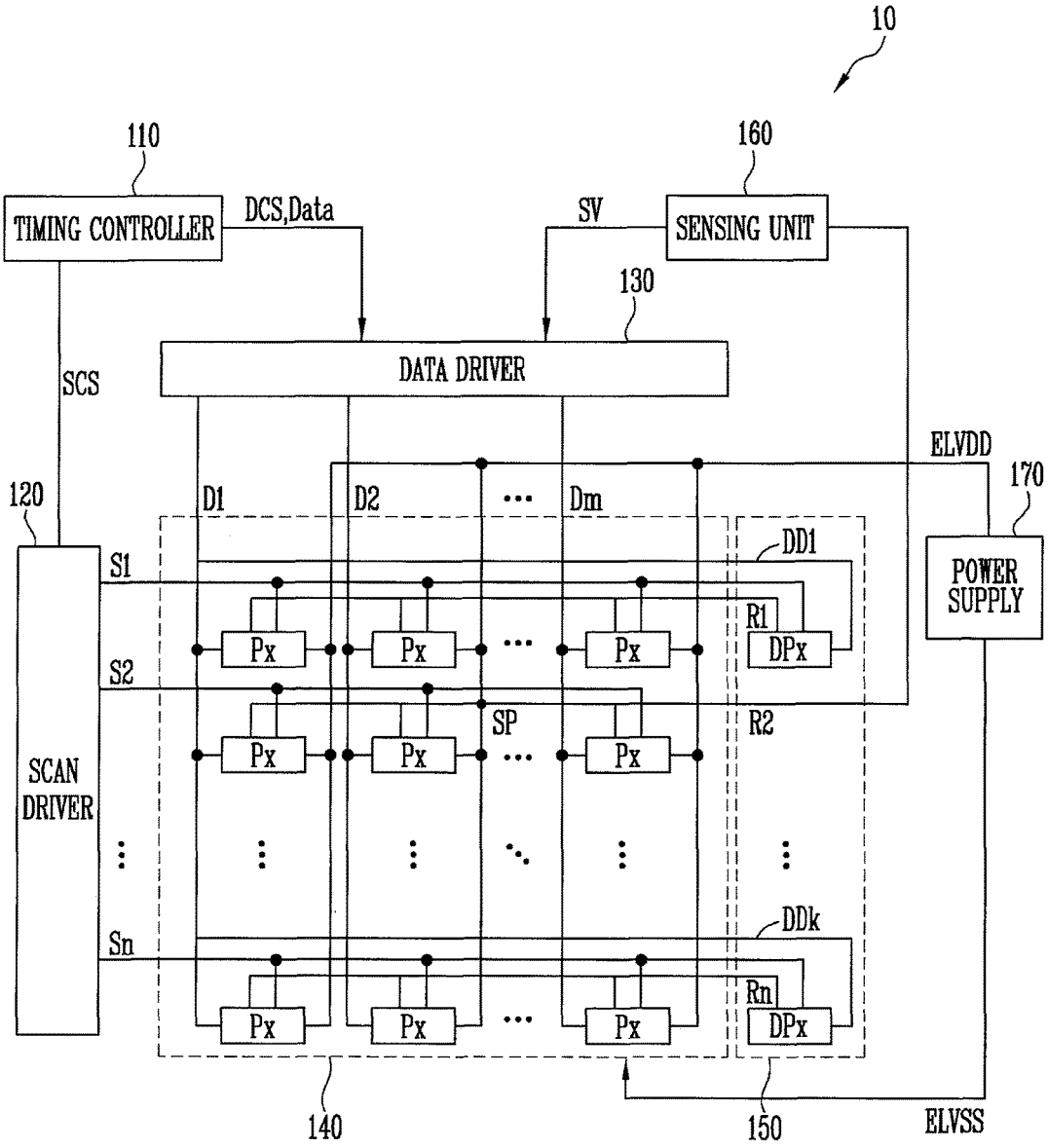
FIG. 1 is a diagram illustrating a display device according to an embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, various examples of embodiments will be described in detail with reference to the accompanying drawings.

Figure 2:
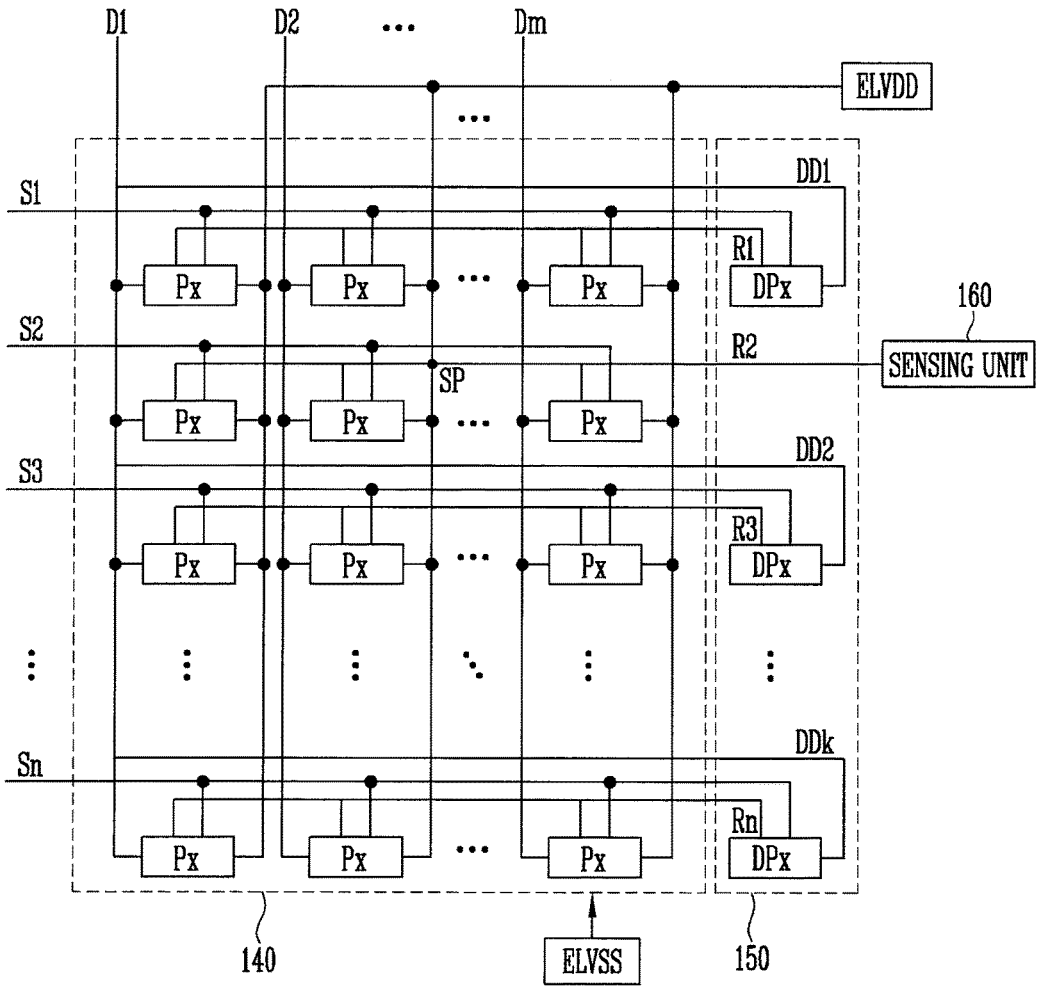
FIG. 2 is a diagram illustrating positions of pixels and dummy pixels.

FIG. 1 is a diagram illustrating a display device according to an embodiment of the present invention, and FIG. 2 is a diagram illustrating positions of pixels and dummy pixels in more detail.

Referring to FIGS. 1 and 2, a display device 10 may include a timing controller 110, a scan driver 120, a data driver 130, a display region 140, a dummy pixel unit 150, a sensing unit 160, and a power supply 170.

A timing controller 110 may generate a data driving control signal DCS and a scan driving control signal SCS in response to synchronization signals (e.g., a vertical synchronization signal, a horizontal synchronization signal, a data enable signal, and/or a video data signal). The timing controller 110 may supply the data driving control signal DCS to the data driver 130, and may supply the scan driving control signal SCS to the scan driver 120. Also, the timing controller 110 may supply externally supplied video data "Data" to the data driver 130.

The scan driver 120 may sequentially supply a scan signal to scan lines (S1, S2, . . . Sn) according to the scan driving control signals SCS supplied from the timing controller 110.

The data driver 130 may generate data signals by using the video data "Data" and by using the data driving control signal DCS input from the timing controller 110, and may supply the data signals to respective ones of the data lines (D1, D2, . . . , Dm). The data driver 130 may be formed on a display panel of the display device 10, or may be mounted on the display panel in an integrated circuit form.

The display region 140 may refer to an active area for displaying images. The display region 140 includes pixels Px in an area formed with the data lines (D1, D2, . . . , Dm) and the scan lines (S1, S2, . . . Sn).

The data signals may be supplied to each of pixels Px through a corresponding selected data line (any one among D1 to Dm) when the scan signal is supplied to a corresponding scan line (any one among S1 to Sn). When the data signal is supplied to each of the pixels Px, the pixels may emit light with brightness corresponding to the data signal. To this end, each of the pixels Px may include an organic light emitting diode.

A first power voltage ELVDD and a second power voltage ELVSS from the power supply 170 may be supplied to the pixels Px. An embodiment of the pixels Px according to the present invention is further described with reference to FIG. 4.

A dummy pixel unit 150 may be formed in a non-active area (e.g., an area outside of the active area 140) of the display device 10. The dummy pixel unit 150 may include at least one dummy pixel DPx for each horizontal line, and the at least one dummy pixel DPx for each horizontal line may be respectively connected to a repair line (R1 to Rn). For, example, the dummy pixel DPx formed on an ith (i is a natural number) horizontal line may be electrically connected to ith repair line (Ri).

The repair lines (R1 to Rn) may be formed in parallel with the scan line. The repair lines (R1 to Rn) may be used to repair the pixels Px. For example, if a pixel Px on an ith horizontal line is found to be a defective pixel, an organic light emitting diode included in the pixel Px on the ith horizontal line may be coupled to an ith repair line (Ri) by a laser short. Accordingly, the organic light emitting diode in the pixel Px may be operated by a current supplied from the dummy pixel DPx disposed on an ith horizontal line.

The dummy pixels DPx may be used to repair corresponding pixels Px in a display area 140, and the dummy pixels DPx may or may not include an organic light emitting diode. Further, the dummy pixels DPx may be coupled to at least one of the dummy data lines (DD1 to DDk (k is a natural number)) formed in the display area 140.

The dummy data lines (DD1 to DDk) may overlap with the data lines (D1 to Dm), and may be coupled to the data lines (D1 to Dm) during a repair period of the pixels Px.

The sensing unit 160 may be coupled to a repair line(s) R2 that is not coupled to the dummy pixels DPx, and may measure the first power voltage ELVDD of the target point SP through the repair line R2.

The target point SP may be a point where a first power line for supplying the first power voltage ELVDD is electrically coupled to a repair line R2. According to an embodiment of the present invention, the target point SP may be in the vicinity of a center of the display area 140, and may be on one or more horizontal lines.

The sensing unit 160 may transfer a measured detection voltage SV from the target point SP to the data driver 130. Here, the detection voltage SV measured at the target point SP may be the first power voltage ELVDD.

The power supply 170 may be outside the display area 140, and may supply power to the pixels Px of the display area 140. For example, the power supply 170 may receive a predetermined voltage from a power source such as a battery, may convert the supplied voltage into the first power voltage ELVDD and the second power voltage ELVSS, which may be used by the pixels Px, and may supply the first power voltage ELVDD and the second power voltage ELVSS to the pixels Px.

Figure 3:
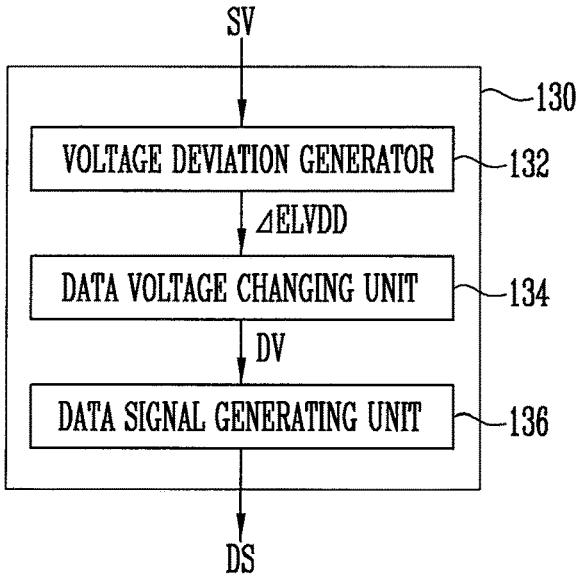
FIG. 3 is a diagram illustrating a data driver according to an embodiment of the present invention.

FIG. 3 is a diagram illustrating the data driver according to an embodiment of the present invention.

According to an embodiment, the data driver 130 may generate a corrected data signal reflecting a voltage drop from the first power voltage ELVDD supplied from the power supply 170, which is generated in the display area 140, and may eliminate a brightness deviation by a change of the first power voltage ELVDD.

Referring to FIGS. 1 and 3, the data driver 130 may include a voltage deviation generator (e.g., a voltage adjustment generator) 132, a data voltage changing unit 134, and a data signal generating unit 136.

The voltage deviation generator 132 may generate the deviation (e.g., adjustment) of the first power voltage ΔELVDD based on the detection voltage SV corresponding to the target point SP. The voltage deviation generator 132 may receive the detection voltage SV from the sensing unit 160, may compare the received detection voltage SV with a reference voltage, and may generate the deviation of the first power voltage ΔELVDD from the target point SP based on the comparison of the voltage values.

The reference voltage may be preset by the voltage deviation generator 132 to measure the deviation of the first power voltage ΔELVDD. The reference voltage may be equal to the first power voltage ELVDD intended to be supplied from the target point SP to the pixel Px. The detected voltage SV, the reference voltage, and the deviation of the first power voltage ΔELVDD may have a relation corresponding to a following equation: deviation of the first power voltage ΔELVDD=reference voltage−detected voltage SV. For example, if the detected voltage SV measured in the target point SP is 4.5V, and if the reference voltage is 4.6V, then the deviation of the first power voltage ΔELVDD may be 0.1 V.

According to an embodiment, the voltage deviation generator 132 may convert the detected voltage SV into a digital value by using an analog-digital converter, and may generate the deviation of the first power voltage ΔELVDD by comparing the digital value with the reference voltage represented by another digital value.

The data voltage changing unit 134 may generate a compensated data voltage DV by using the deviation of the first power voltage ΔELVDD.

If the value of the first power voltage ELVDD to be supplied to a pixel Px changes, the pixel Px might not emit light with desired brightness. Accordingly, the data voltage changing unit 134 may generate a compensated data voltage DV by adjusting a voltage, which has a voltage level corresponding to the data signal to be supplied to the target point SP, by a voltage amount corresponding to the deviation of the first power voltage ΔELVDD.

The data signal generating unit 136 may generate a compensated data signal DS corresponding to the compensated data voltage DV. Then, the data driver 130 may supply the compensated data signal DS to the target point SP, and the pixels Px included in the target point may emit light with desired brightness.

Figure 4:
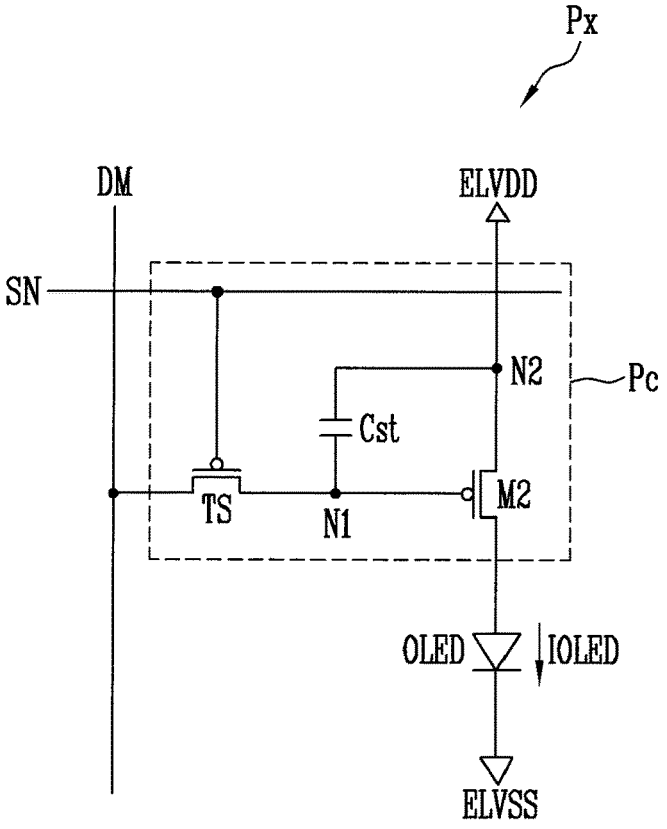
FIG. 4 is a diagram illustrating a circuit of pixels according to an embodiment of the present invention.

FIG. 4 is a diagram of a pixel circuit according to an embodiment of the present invention. For the convenience of the description, FIG. 4 illustrates a pixel coupled with an nth scan line SN and an mth data line DM.

Referring to FIG. 4, the pixel may include an organic light emitting diode OLED, the data line DM, and a pixel circuit Pc coupled to the scan line SN to control the organic light emitting diode OLED.

An anode electrode of the organic light emitting diode OLED is coupled to the pixel circuit Pc, and a cathode electrode of the organic light emitting diode OLED may be coupled to the second power source ELVSS. As described above, the organic light emitting diode OLED may emit the light having brightness corresponding to a current supplied from the pixel circuit Pc.

When the scan signal is supplied to the scan line SN, the pixel may control the current amount supplied to the organic light emitting diode OLED in response to the data signal supplied to the data line DM.

To this end, the pixel circuit Pc may include a second transistor M2 coupled between the first power source ELVDD and the organic light emitting diode OLED, a first transistor TS coupled between the second transistor M2, the data line DM, and the scan line SN, and a storage capacitor Cst coupled between a gate electrode and a first electrode of the second transistor M2. The gate electrode of the first transistor TS may be coupled to the scan line SN, the first electrode of the first transistor TS may be coupled to the data line DM, and the second electrode of the first transistor TS may be coupled to one end of the storage capacitor Cst.

Either a source electrode or a drain electrode may be set as the first electrode, with the other one being set as the second electrode. For example, if the source electrode is set as the first electrode, the drain electrode may be set as the second electrode.

The first transistor TS coupled to the scan line SN and the data line DM may be turned on when the scan signal is supplied form the scan line SN, and may supply the data signal supplied from the data line DM to the storage capacitor Cst. The storage capacitor Cst may be charged with a voltage corresponding to the data signal.

The gate electrode of the second transistor M2 may be coupled to one end of the storage capacitor Cst, and the first electrode may be coupled to another end of the storage capacitor Cst and coupled to a first power source ELVDD. The second electrode of the second transistor M2 may be coupled to an anode electrode of the organic light emitting diode OLED. As described above, the second transistor M2 may control the amount of current flowing from the first power source ELVDD passing the organic light emitting diode OLED and to the second power source ELVSS in response to a voltage value stored in the storage capacitor Cst. The organic light emitting diode OLED may emit light with brightness corresponding to the amount of the current supplied from the second transistor M2.

It should be noted that the pixel structure illustrated in FIG. 4 is merely one of the embodiments of the present invention, and that the present invention is not limited thereto. The pixel circuit may have a circuit structure capable of supplying a current to the organic light emitting diode OLED, and the circuit structure may be any one of known circuit structures.

The second power source ELVSS may be supplied to each of the pixels Px along with the first power source ELVDD, which may be generated from a separate power supply and supplied in a manner that is substantially the same as the first power source ELVDD. The first power source ELVDD may be set with a positive electrode voltage, and the second power source ELVSS may be set with a negative electrode voltage.

Figure 5:
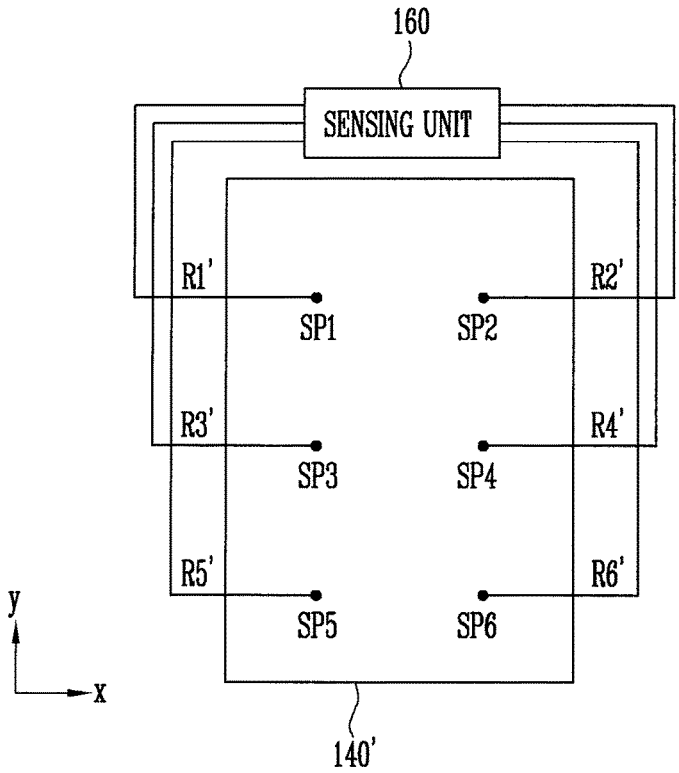
FIG. 5 is a diagram illustrating the position of a target point in the display region according to an embodiment of the present invention.

FIG. 5 is a diagram illustrating a position of a target point in a display area according to an embodiment of the present invention.

Referring to FIG. 5, the display device 10 according to an embodiment of the present invention may include a display area 140' formed in a rectangular shape having a pair of short sides (e.g., sides extending along an X-axis of the display area 140') and a pair of long sides (e.g., sides extending along a Y-axis of the display area 140').

The display area 140' may include repair lines (R1', R2', R3', R4', R5', and R6') formed along a horizontal line (extending along the X-axis). The repair lines (R1', R2', R3', R4', R5' and R6') may also be formed along the horizontal line extending from both long sides of the display area 140' to an inside of the display area 140'.

The display area 140' may include target points (SP1, SP2, SP3, SP4, SP5, and SP6) that are electrically connected with a first power line and with a respective one of the repair lines (R1', R2', R3', R4', R5' and R6'). The sensing unit 160 may detect the first power voltage ELVDD from each of the target points (SP1, SP2, SP3, SP4, SP5, and SP6).

The target points may be formed on one or more horizontal lines. For example, the first target point SP1 and the second target point SP2 may be formed on a substantially same first horizontal line, the third target point SP3 and the fourth target point SP4 may be formed on a substantially same second horizontal line, and the fifth target point SP5 and the sixth target point SP6 may be formed on a substantially same third horizontal line.

The first target point SP1, the third target point SP3, and the fifth target point SP5 may be formed on a substantially same first vertical line (extending in a parallel direction with the Y-axis), and the second target point SP2, the fourth target point SP4 and the sixth target point SP6 may be formed on a substantially same second vertical line.

An embodiment of the present invention illustrates position structures of the first to sixth target points SP1 to SP6, although it should be noted that the number of target points may change, and that the target points may be different arranged depending on connection structures between the first power line and the repair lines inside the display area 140'.

Figure 6:
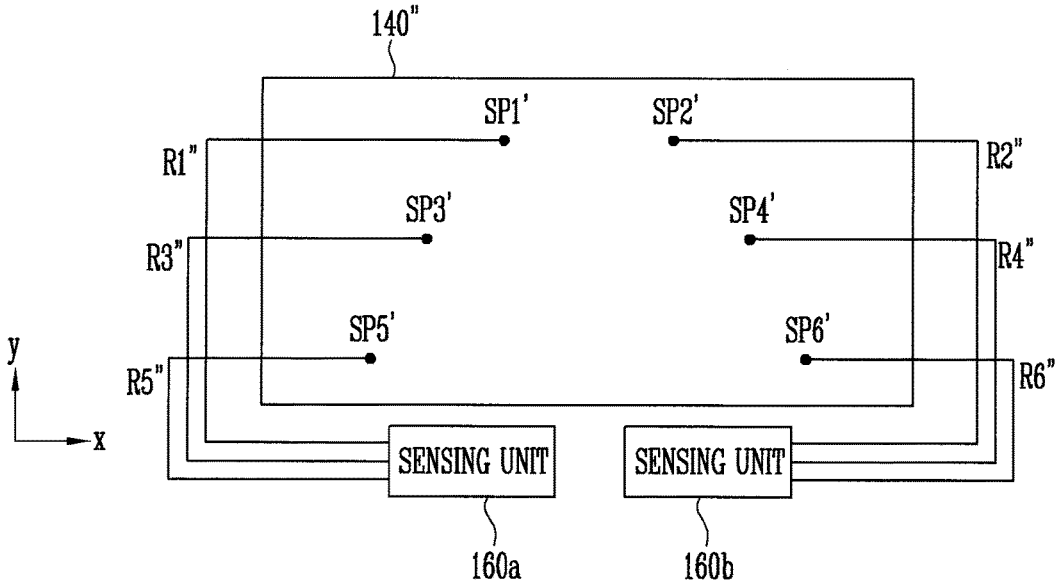
FIG. 6 is a diagram illustrating the position of a target point in the display region according to another embodiment of the present invention.

FIG. 6 is a diagram illustrating positions of target points in a display area according to another embodiment of the present invention. FIG. 6 is a modified embodiment of the display 140' shown in FIG. 5. Thus, repeated descriptions may be omitted.

Referring to FIG. 6, the display device 10 according to an embodiment of the present invention may include a display area 140" in a rectangular shape having a pair of long sides (e.g., sides extending along an X-axis direction of the display area 140") and a pair of short sides (e.g., sides extending along a Y-axis of the display area 140").

The display area 140" may include repair lines R1", R2", R3", R4", R5", and R6" formed on a horizontal line (extending in parallel with the X-axis). The repair lines may also be formed along a horizontal line from both long sides to an inside of the display area 140".

Target points (SP1', SP2', SP3', SP4', SP5', and SP6') may be formed on one or more horizontal lines. For example, a first target point SP1' and a second target point SP2' may be formed on a substantially same first horizontal line, a third target point SP3' and a fourth target point SP4' may be formed on a substantially same second horizontal line, and a fifth target point SP5' and a target point SP6' may be formed on a substantially same third horizontal line.

The third target point SP3' may be formed closer to a left short side (e.g., in a negative X-axis direction) when compared to the first target point SP1', and the fifth target point SP5' may be formed closer to the left short side when compared to the third target point SP3'.

The fourth target point SP4' may be formed closer to a right short side (in a positive X-axis direction) when compared to the second target point SP2', and the sixth target point SP6' may be formed closer to the right short side when compared to the fourth target point SP4'.

Figure 7:
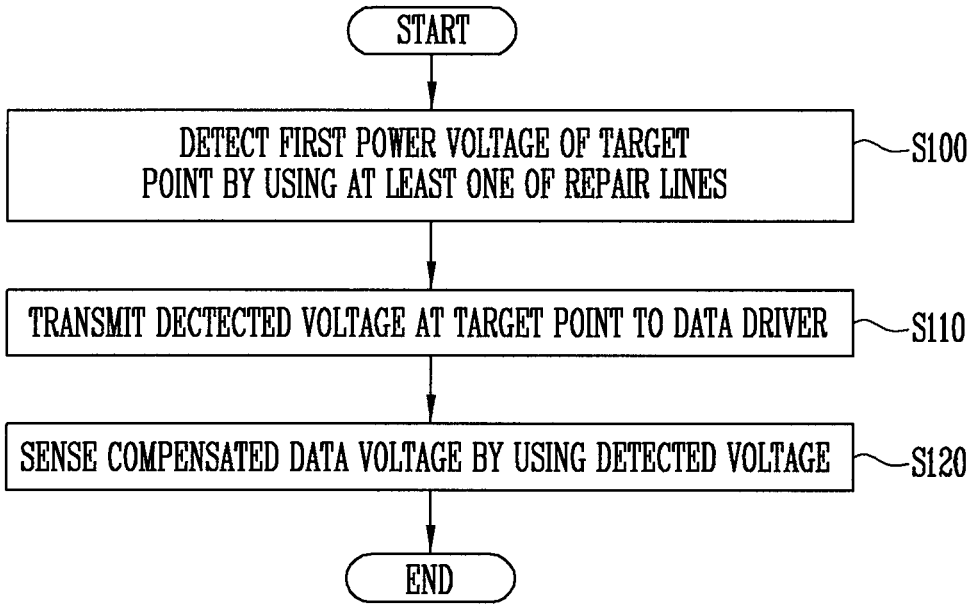
FIG. 7 is a diagram illustrating an operation method of the display device according to an embodiment of the present invention.

FIG. 7 is a diagram illustrating a method for operating a display device according to an embodiment of the present invention.

Referring to FIGS. 1 and 7, the display device 10 may include pixels Px at respective crossing regions of scan lines S1 to Sn and data lines D1 to Dm, dummy pixels DPx coupled to any one of repair lines R1 to Rn that are connected in parallel with the scan lines S1 to Sn, and a sensing unit 160 coupled to at least one of the repair lines R2 that are not connected to the dummy pixels DPx.

The sensing unit 160 may select a target point SP, among points of electrical connection, where the at least one of the repair lines R1 to Rn is electrically connected to the first power lines for supplying the first power voltage ELVDD.

The sensing unit 160 may detect the first power voltage ELVDD of the target point SP through at least one of the repair lines R2 (S100).

The sensing unit 160 may transmit a detected voltage SV measured from the target point SP to the data driver 130 (S110).

The driving unit 130 may generate a deviation of the first power voltage ΔELVDD by comparing the detected voltage SV with a reference voltage at the target point SP, and may generate a compensated data voltage DV by adjusting a voltage, which corresponds to the data signal to be supplied to the target point SP, by a voltage corresponding to the deviation of the first power voltage ΔELVDD (S120).

The data driver 130 may generate and supply a compensated data signal DS corresponding to a compensated data voltage DV to a pixel Px connected to the first power line at the target point SP in response to the scan signal supplied through the scan lines S1 to Sn.

Example embodiment have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics and/or elements described in connection with a particular embodiments may be used singly or in combination with features, characteristics, and/or elements described in connection with other embodiments unless otherwise specifically indicated. Accordingly, it will be understood by those of skilled in the art that various changes in form and details may be made without departing from the spirit and scope of the present invention as set forth in the following claims and their equivalents.

What is claimed is:

1. A display device comprising:

a display area comprising pixels connected to scan lines and data lines;

a power supply configured to supply a first power voltage to the pixels through first power lines;

a dummy pixel unit comprising dummy pixels;

a sensing unit; and repair lines comprising a first repair line connected to one of the dummy pixels and a second repair line that is connected to the sensing unit in lieu of any of the dummy pixels, wherein the sensing unit measures the first power voltage at a target point through the second repair line, wherein the target point is a direct connection point between one of the first power lines and the second repair line, and wherein a number of the repair lines is the same as a number of the scan lines.

2. The display device of claim 1, wherein the target point is on at least one horizontal line.

3. The display device of claim 1, wherein the target point is in a vicinity of a center of the display area.

4. The display device of claim 1, further comprising a data driver configured to supply a data signal through the data lines.

5. The display device of claim 4, wherein the sensing unit transmits a detected voltage to the data driver.

6. The display device of claim 4, wherein the data driver comprises:

a voltage deviation generator configured to generate a deviation of the first power voltage; and a data voltage changing unit configured to generate a compensated data voltage by using the deviation of the first power voltage.

7. The display device of claim 6, wherein the voltage deviation generator is configured to generate the deviation of the first power voltage by comparing a detected voltage corresponding to the measured first power voltage at the target point with a reference voltage of the target point.

8. The display device of claim 6, wherein the data voltage changing unit is configured to generate the compensated data voltage by adjusting a voltage corresponding to the data signal by an amount corresponding to the deviation of the first power voltage.

9. The display device of claim 1, wherein a respective one of the dummy pixels is on each horizontal line of the display area, and wherein one of the dummy pixels on an ith (i is a natural number) horizontal line is coupled between a kth (k is a natural number) dummy data line and an ith repair line.

10. The display device of claim 9, wherein, when one of the pixels on the ith horizontal line is identified as defective, the ith repair line is configured to be electrically coupled to an organic light emitting diode in the one of the pixels, and the kth dummy data line is configured to be electrically coupled to one of the data lines connected to the one of the pixels.

11. A method for operating a display device comprising pixels connected to scan lines and data lines, dummy pixels, a sensing unit, repair lines comprising a first repair line connected to one of the dummy pixels and at least one of second repair lines that is connected to the sensing unit in lieu of any of the dummy pixels, and a power supply configured to supply a first power voltage to the pixels through first power lines, the method comprising:

detecting a first power voltage at a target point using the at least one of the second repair lines;

transmitting the detected first power voltage to a data driver; and generating a compensated data voltage from the data driver by using the detected first power voltage, wherein the target point is a direct connection point between one of the first power lines and the at least one of second repair lines, and wherein a number of the repair lines is the same as a number of the scan lines.

12. The method of claim 11, further comprising selecting the target point from among respective points of direct connections between the second repair lines and the first power lines.

13. The method of claim 12, wherein the target point is on at least one of horizontal lines.

14. The method of claim 11, wherein the target point is in a vicinity of a center of a display area comprising the pixels.

15. The method of claim 11, wherein the generating of the compensated data voltage comprises:

generating a deviation of the first power voltage by comparing the detected first power voltage with a reference voltage of the target point, and generating a compensated data voltage by adjusting a voltage corresponding to a data signal to be supplied to the target point by an amount corresponding to the deviation of the first power voltage.

16. The method of claim 11, further comprising supplying a compensated data signal, which corresponds to the compensated data voltage, to a pixel coupled to a first power line at the target point in response to a scan signal supplied through a respective one of the scan lines.

* * * * *